US010642301B2

(12) United States Patent
Liu et al.

(10) Patent No.: US 10,642,301 B2
(45) Date of Patent: May 5, 2020

(54) POWER CONVERSION APPARATUS FOR TRACKING MAXIMUM POWER POINT AND CONTROL METHOD THEREOF

(71) Applicant: RICHTEK TECHNOLOGY CORPORATION, Zhubei, Hsinchu (TW)

(72) Inventors: Kuo-Chi Liu, Hsinchu (TW); Chang-Yu Ho, Hsinchu (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 16/280,941

(22) Filed: Feb. 20, 2019

(65) Prior Publication Data

US 2019/0317540 A1 Oct. 17, 2019

Related U.S. Application Data

(60) Provisional application No. 62/657,649, filed on Apr. 13, 2018.

(30) Foreign Application Priority Data

Sep. 7, 2018 (CN) ..... 2018 1 1041988

(51) Int. Cl.
*G05F 1/67* (2006.01)

(52) U.S. Cl.
CPC ..... *G05F 1/67* (2013.01)

(58) Field of Classification Search
CPC ..... G05F 1/67
See application file for complete search history.

(56) References Cited

U.S. PATENT DOCUMENTS

2014/0054969 A1* 2/2014 Beijer ..... G05F 1/67 307/78
2017/0117818 A1* 4/2017 Shao ..... H02M 7/066

FOREIGN PATENT DOCUMENTS

DE 3725476 A1 * 2/1989 ..... G05F 1/67

OTHER PUBLICATIONS

Machine Translation of DE3725476A, EPO translation, translated Sep. 4, 2019, 6 pages. (Year: 2019).*

* cited by examiner

*Primary Examiner* — Harry R Behm
(74) *Attorney, Agent, or Firm* — Tung & Associates

(57) ABSTRACT

A power conversion apparatus for tracking maximum power point, includes: a signal processing circuit, which generates a sensing signal at a sensing node according to an input voltage; and a comparison circuit, which controls a converter circuit according to a difference between the sensing signal and a reference voltage, to convert the input voltage to an output power. The signal processing circuit includes: a bias sensing circuit, which generates the sensing signal at the sensing node according to the input voltage; and a clamp circuit coupled to the sensing node, for clamping the sensing signal to be not greater than a clamp voltage. The converter circuit adjusts an output voltage and/or an output current of the output power, so that a power retrieval source operates near its maximum power point.

21 Claims, 7 Drawing Sheets

POWER CONVERSION APPARATUS FOR TRACKING MAXIMUM POWER POINT AND CONTROL METHOD THEREOF

CROSS REFERENCE

The present invention claims priority to U.S. 62/657,649, filed on Apr. 13, 2018 and CN 201811041988.0, filed on Sep. 7, 2018.

BACKGROUND OF THE INVENTION

Field of Invention

The present invention relates to a power conversion apparatus. In particular, the present invention relates to a power conversion apparatus for tracking maximum power point. The present invention also relates to a control method for a power conversion apparatus for tracking maximum power point.

Description of Related Art

As shown in FIG. 1, U.S. Pat. No. 6,984,970 discloses a conventional power conversion apparatus (power conversion apparatus 1). The power conversion apparatus 1 senses an input voltage Vin and an input current Ic supplied from a power retrieval source 7 (e.g., a photovoltaic battery), and calculates power by a calculation circuit 21, to thereby control a converter circuit 14 to track a maximum power point of the power retrieval source 7.

The prior art shown in FIG. 1 has a drawback that: the prior art needs to sense both the input voltage Vin and the input current Ic supplied from the power retrieval source 7, and to calculate power by the calculation circuit 21, whereby the circuitry of this prior art is complicated and not cost-effective.

As shown in FIG. 2, U.S. Pat. No. 4,604,567 discloses another conventional power conversion apparatus (power conversion apparatus 2). The power conversion apparatus 2 turns OFF a power switch 24 to sample-and-hold an open-circuit voltage of a photovoltaic battery 10, thereby tracking a maximum power point of the photovoltaic battery 10.

The prior art shown in FIG. 2 has a drawback that: to track a maximum power point of the photovoltaic battery 10, the prior art needs to keep turning ON and OFF the circuit loop of the whole power conversion apparatus 2; such operation will adversely affect the operation of downstream circuits such as prolonging the charging period of a downstream storage battery 14 or impacting the operation of a downstream load circuit 12.

In view of the above, the present invention provides a power conversion apparatus for tracking maximum power point to overcome the drawbacks in the prior art. Compared to the prior arts shown in FIG. 1 and FIG. 2, the present invention has merits of simpler circuit configuration and lower cost. Compared to the prior arts shown in FIG. 2, the present invention does not require turning OFF the circuit loop and can provide uninterrupted charging operation.

SUMMARY OF THE INVENTION

From one perspective, the present invention provides a power conversion apparatus for tracking maximum power point, which receives an input power supplied by a power retrieval source; the power conversion apparatus comprising: a signal processing circuit, which is configured to operably generate a sensing signal at a sensing node according to an input voltage of the input power; a comparison circuit, which is configured to operably generate a control signal according to a difference between the sensing signal and a reference voltage; and a converter circuit, which is configured to operably convert the input power to an output power according to the control signal, so as to supply the output power to a load circuit; wherein the signal processing circuit includes: a bias sensing circuit coupled between the input power and the sensing node, wherein the bias sensing circuit is configured to operably generate the sensing signal at the sensing node according to the input voltage; and a clamp circuit coupled to the sensing node, wherein the clamp circuit is configured to operably clamp the sensing signal so that the sensing signal is not greater than a clamp voltage; wherein the converter circuit adjusts an output voltage and/or an output current of the output power according to the control signal, so that the power retrieval source operates near a maximum power point.

In one embodiment, the bias sensing circuit includes: a bias device, which is configured to operably supply a bias current; and a sensing capacitor, wherein the sensing capacitor and the bias device are connected in parallel between the input power and the sensing node.

In one embodiment, the clamp circuit includes one of the followings or combination thereof: (1) a diode, wherein the clamp voltage is related to a forward bias voltage of the diode; (2) a Zener diode, wherein the clamp voltage is related to a Zener voltage of the Zener diode; and/or (3) a transistor having a control terminal coupled to a bias voltage and having a same-phase voltage input end coupled to the sensing node, wherein the clamp voltage is related to the bias voltage and an ON-threshold voltage of the transistor.

In one embodiment, the signal processing circuit further includes: an offset device, wherein the offset device and the bias sensing circuit are connected in series between the input power and the sensing node, the offset device being configured to operably supply an offset voltage, so as to generate the sensing signal.

In one embodiment, the offset device includes an offset diode, and the offset voltage is related to a forward bias voltage of the offset diode.

In one embodiment, when the sensing signal exceeds the reference voltage, the converter circuit raises up the output voltage and/or the output current; and when the sensing signal does not exceed the reference voltage, the converter circuit lowers down the output voltage and/or the output current, such that the power retrieval source operates near the maximum power point.

In one embodiment, when the input voltage increases whereby the clamp circuit starts to function and the clamp circuit clamps the sensing signal at the clamp voltage, the sensing capacitor samples a voltage difference between the input voltage and the clamp voltage; and when the input voltage decreases whereby the clamp circuit does not function, the sensing capacitor holds the voltage difference such that the sensing signal is lower than the clamp voltage and the sensing signal is positively correlated with the input voltage.

In one embodiment, the bias device is a bias resistor, and wherein a resistance of the bias resistor and a capacitance of the sensing capacitor are so arranged that the sensing capacitor holds the voltage difference for at least a predetermined holding period.

In one embodiment, the predetermined holding period is related to an operation bandwidth of the power conversion apparatus.

In one embodiment, the bias resistor is a parasitic resistor of the sensing capacitor.

In one embodiment, the clamp voltage is greater than the reference voltage.

In one embodiment, the reference voltage is any value between the clamp voltage and zero.

In one embodiment, the reference voltage is not correlated to an operation parameter of the maximum power point of the power retrieval source.

In one embodiment, voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than ½ of the maximum trackable voltage.

In one embodiment, voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than ⅕ of the maximum trackable voltage.

In one embodiment, voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than 1/10 of the maximum trackable voltage.

In one embodiment, the power retrieval source includes a photovoltaic battery, which is configured to operably retrieve a solar power to supply the input power.

In one embodiment, the power retrieval source and the clamp circuit include semiconductor junctions of same characteristics, such that a variation of the clamp voltage and a variation of the input voltage with respect to a temperature change are positively correlated to each other.

From another perspective, the present invention provides a control method for a power conversion apparatus, wherein the power conversion apparatus receives an input power supplied by a power retrieval source, and the power conversion apparatus includes a converter circuit; the control method comprising: generating a sensing signal at a sensing node according to an input voltage of the input power; controlling the converter circuit according to a difference between the sensing signal and a reference voltage, to convert the input power to an output power and to supply the output power to a load circuit; and clamping the sensing signal such that the sensing signal is not greater than a clamp voltage; wherein the converter circuit is controlled to adjust an output voltage and/or an output current of the output power, so that the power retrieval source operates near a maximum power point.

In one embodiment, the step for generating the sensing signal includes: sensing an input voltage by a sensing capacitor and a bias device connected in parallel with each other, so as to generate the sensing signal at the sensing node; wherein the sensing capacitor and the bias device connected in parallel with each other are coupled between the input power and the sensing node.

In one embodiment, the sensing signal is clamped by one of the followings or a combination thereof: (1) a diode, wherein the clamp voltage is related to a forward bias voltage of the diode; (2) a Zener diode, wherein the clamp voltage is related to a Zener voltage of the Zener diode; and/or (3) a transistor having a control terminal coupled to a bias voltage and having a same-phase voltage input end coupled to the sensing node, wherein the clamp voltage is related to the bias voltage and an ON-threshold voltage of the transistor.

The objectives, technical details, features, and effects of the present invention will be better understood with regard to the detailed description of the embodiments below.

DESCRIPTION OF THE PREFERRED EMBODIMENTS

The drawings as referred to throughout the description of the present invention are for illustration only, to show the interrelations between the circuits and the signal waveforms, but not drawn according to actual scale of circuit sizes and signal amplitudes and frequencies.

Figure 1:
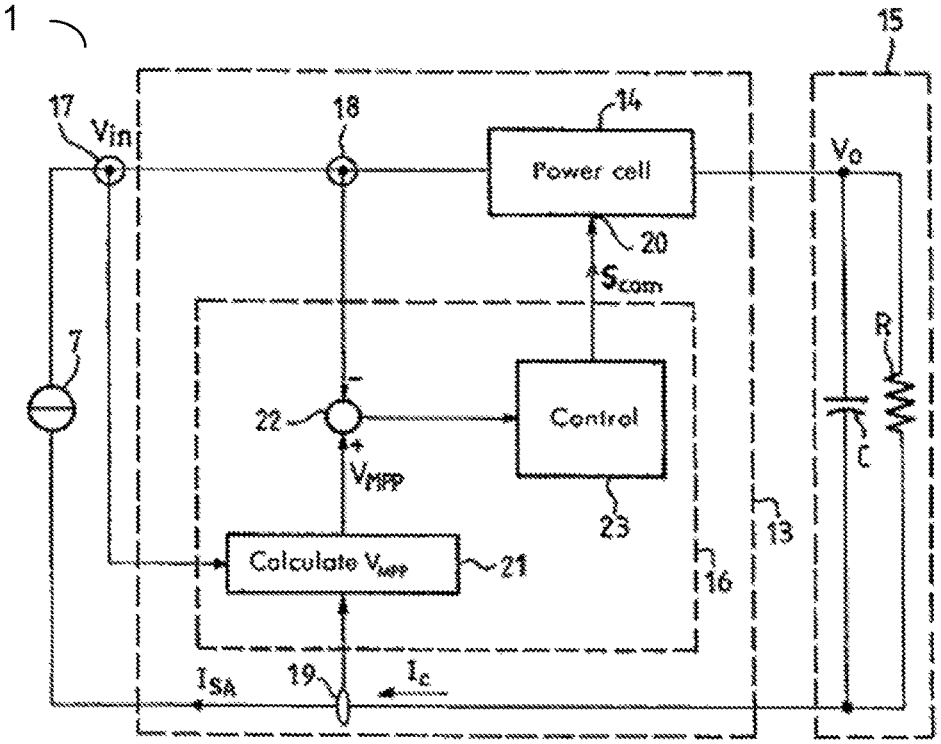
Fig. 1 (Prior Art)
FIG. 1 shows a schematic block diagram of a conventional power conversion apparatus for tracking maximum power point.
Figure 2:
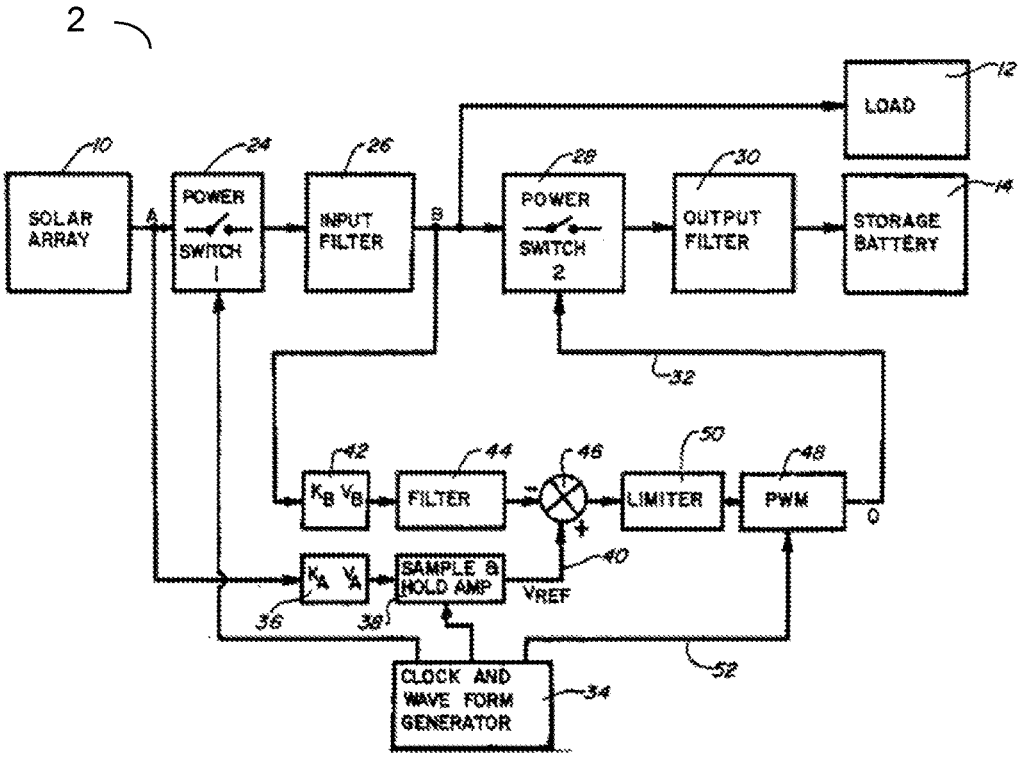
Fig. 2 (Prior Art)
FIG. 2 shows a schematic block diagram of another conventional power conversion apparatus for tracking maximum power point.
Figure 3A:
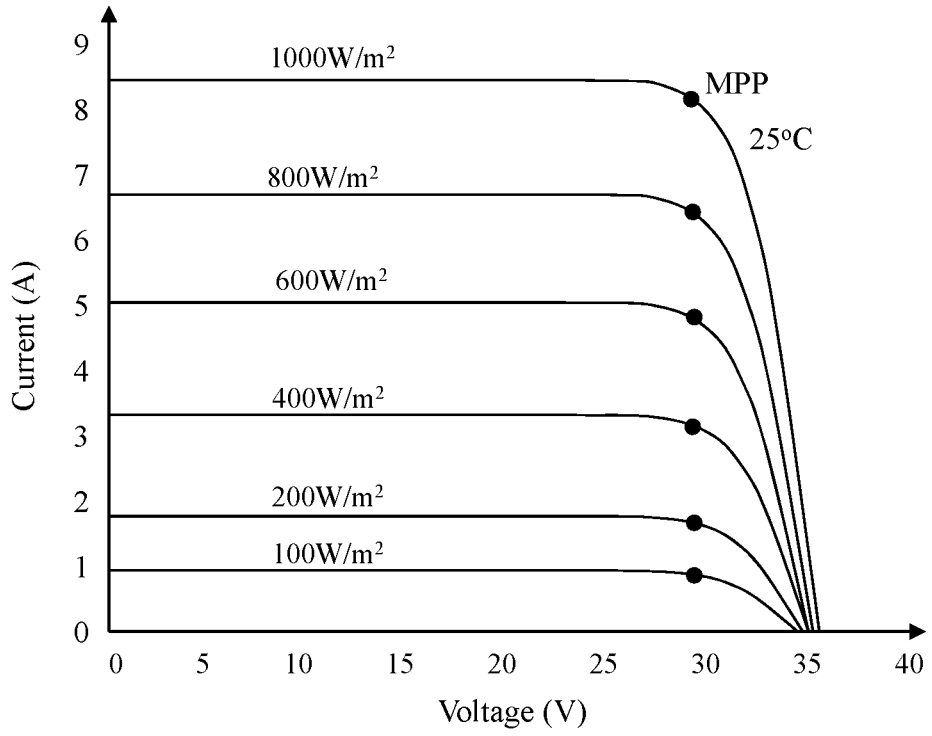
FIG. 3A shows a schematic diagram of a current-voltage characteristic curve of a photovoltaic battery.
Figure 3B:
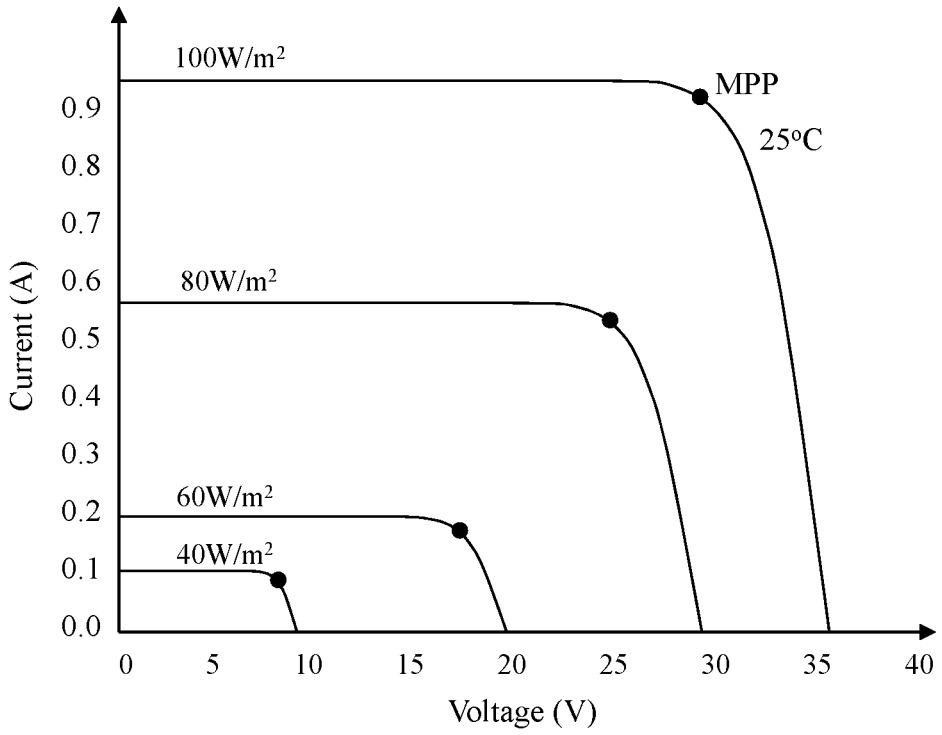
FIG. 3B shows a schematic diagram of a current-voltage characteristic curve of a photovoltaic battery at low illumination intensities.

Please refer to FIG. 3A and FIG. 3B. FIG. 3A and FIG. 3B show schematic diagrams of current-voltage characteristic curves of a photovoltaic battery at different illumination intensities, respectively. As shown in FIG. 3A, when the illumination intensity is greater than a certain value (e.g., equal to or greater than the value 100 W/$m^2$ as shown in FIG. 3A), the voltage at the Maximum Power Point (MPP) at different illumination intensities is substantially the same (e.g., as shown by the value near 30V in FIG. 3A). FIG. 3B is an enlarged view, demonstrating a schematic diagram of a current-voltage characteristic curve of a photovoltaic battery at low illumination intensities. As shown in FIG. 3B, under a circumstance where the illumination intensity is very low, at different illumination intensities, the MPP voltage varies greatly in correlation with the changes in illumination intensities.

Figure 3C:
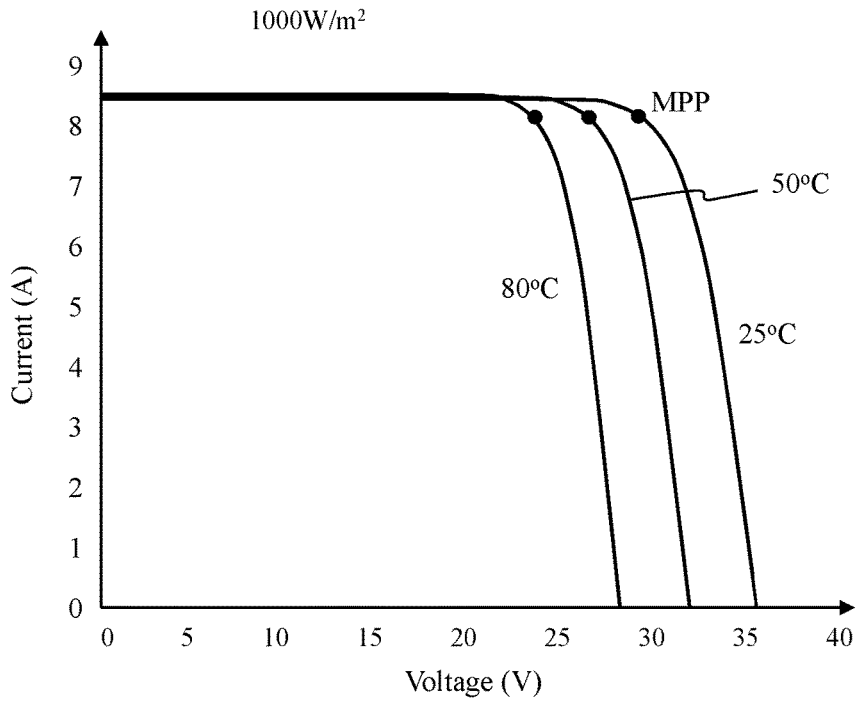
FIG. 3C shows a schematic diagram of a current-voltage characteristic curve of a photovoltaic battery at different temperatures.

Please refer to FIG. 3C, which shows a schematic diagram of a current-voltage characteristic curve of a photovoltaic battery at different temperatures. As shown in FIG. 3C, the MPP voltage of a photovoltaic battery varies in correlation with the changes in temperature. Similarly, under a circumstance where the illumination intensity is very low, the MPP voltage at different illumination intensities varies greatly between one another. In view of this, in addition to the feature that the present invention has merits of simpler circuit configuration and lower cost, the present invention also solves the problem of the variation of the MPP voltage at different low illumination intensities or different temperatures.

Figure 4:
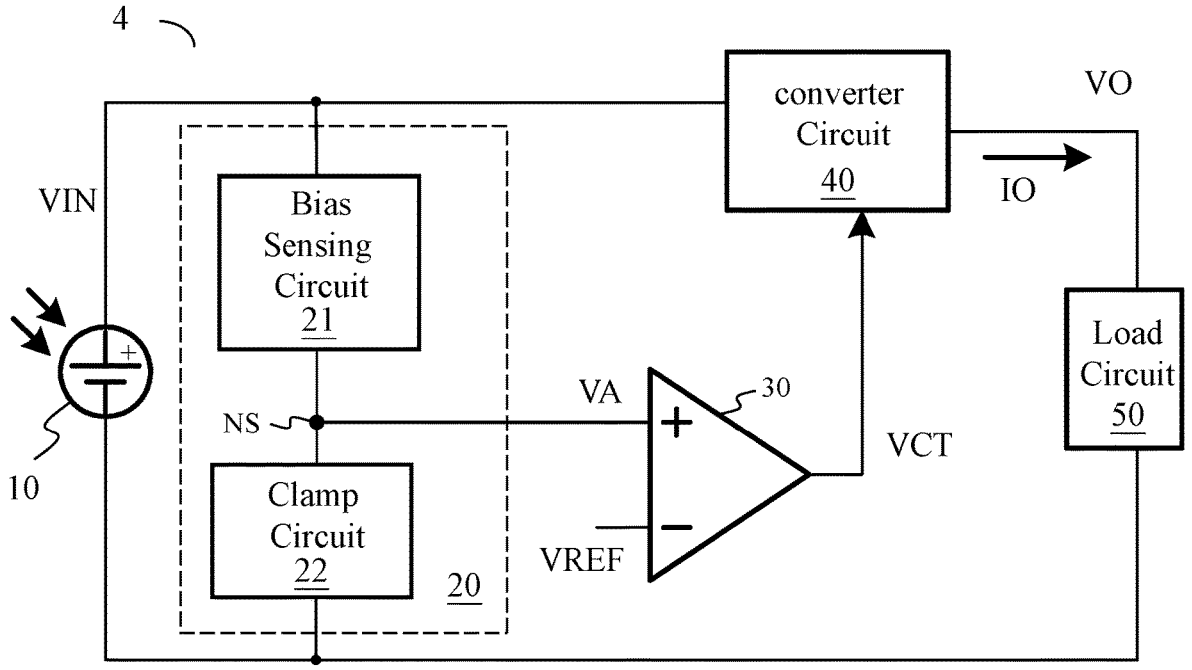
FIG. 4 shows a schematic block diagram of a power conversion apparatus for tracking maximum power point according to an embodiment of the present invention.

Please refer to FIG. 4, which shows a schematic block diagram of a power conversion apparatus for tracking maximum power point according to an embodiment of the present invention (the power conversion apparatus 4). As shown in FIG. 4, a photovoltaic battery 10 (i.e., a power retrieval source) retrieves energy and supplies an input power. In this embodiment, the power conversion apparatus 4 comprises: a signal processing circuit 20, a comparison circuit 30 and a converter circuit 40. The signal processing circuit 20 is configured to operably generate a sensing signal VA at a sensing node NS according to an input voltage VIN of the input power. The comparison circuit 30 is configured to operably generate a control signal VCT according to a difference between the sensing signal VA and a reference voltage VREF. The converter circuit 40 is configured to operably convert the input power to an output power according to the control signal VCT, so as to supply the output power to a load circuit 50. Note that the positive and negative signs of the input terminals of the comparison circuit 30 shown in the figure are only an illustrative example, but not for limiting the scope of the present invention.

The power retrieval source is not limited to a photovoltaic battery 10; it is also practicable and within the scope of the present invention that the power retrieval source can be any other type of power retrieval source. That is, the input power can come from any form of power source, not limited to a photovoltaic power source. The converter circuit 40 for example can be a low dropout regulator (LDO), or a boost, buck, buck-boost, flyback or inverting switching regulator. The load circuit 50 can be a rechargeable battery or any other type of application circuit.

Please still refer to FIG. 4. The signal processing circuit 20 includes a bias sensing circuit 21 and a clamp circuit 22. The bias sensing circuit 21 is coupled between the input power and the sensing node NS. The bias sensing circuit 21 is configured to operably generate the sensing signal VA at the sensing node NS according to the input voltage VIN. The clamp circuit 22 is coupled to the sensing node NS. The clamp circuit 22 is configured to operably clamp the sensing signal VA, so that the sensing signal VA is not greater than a clamp voltage VCP.

The converter circuit 40 can adjust an output voltage VO and/or an output current IO of the output power according to the control signal VCT, so that the photovoltaic battery 10 can operate substantially near a maximum power point (MPP). Note that, because the MPP varies in correlation with the changes in illumination intensities or temperatures, and the circuit devices may have inherent mismatches, the term "operate substantially near" does require the photovoltaic battery 10 to operate precisely at the maximum power point (MPP); instead, a tolerable error is acceptable.

Figure 5:
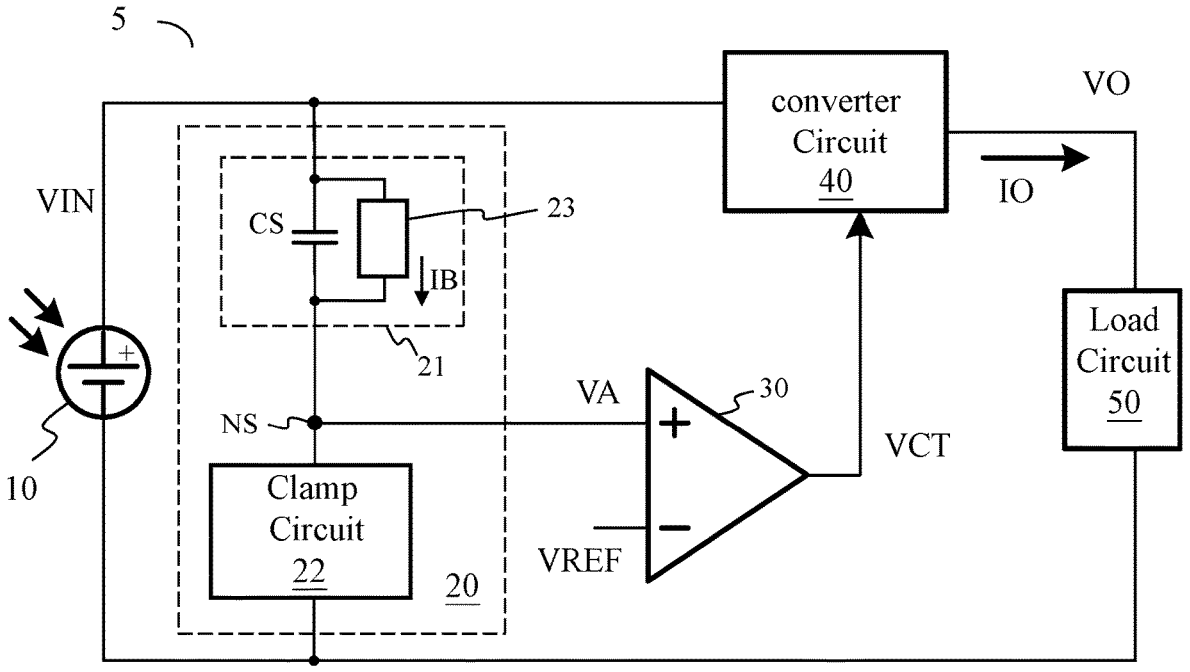
FIG. 5 shows an embodiment of a bias sensing circuit of the present invention.

Please refer to FIG. 5, which shows an embodiment of a bias sensing circuit 21 of the present invention. The bias sensing circuit 21 includes: a bias device 23 and a sensing capacitor CS. The bias device 23 is configured to operably supply a bias current IB. The sensing capacitor CS and the bias device 23 are connected in parallel between the input power and the sensing node NS.

To be more specific, in this embodiment, when the input voltage VIN increases above a certain level whereby the clamp circuit 22 starts to function, the clamp circuit 22 clamps the sensing signal VA at the clamp voltage VCP, and the sensing capacitor CS samples a voltage difference (i.e., VIN−VCP) between the input voltage VIN and the clamp voltage VCP; when the input voltage VIN decreases below a certain level whereby the clamp circuit 22 does not function, the sensing capacitor CS holds the voltage difference (i.e., VIN−VCP) such that the sensing signal VA is lower than the clamp voltage VCP and the sensing signal VA is positively correlated with the input voltage VIN. From another perspective, the sensing capacitor CS can be regarded as high pass filter, by which the sensing signal VA is configured to respond to the high-frequency changes in the input voltage VIN. The bias device 23 is configured to operably provide a direct current route; the bias device 23 operates in coordination with the clamp circuit 22 (i.e., via the bias current IB), to determine a low-frequency operation point of the sensing signal VA.

In the present invention, that the clamp circuit 22 "functions" or "does not function" should be understood as thus. For example, when the input voltage VIN is very high, and if there is no clamp circuit, then the sensing signal VA generated by the bias sensing circuit 21 according to the input voltage VIN will be greater than the clamp voltage VCP; however, if a clamp circuit 22 is provided as taught by the present invention, the clamp circuit 22 will clamp the sensing signal VA to be at the clamp voltage VCP, so that the sensing signal VA is not greater than the clamp voltage VCP, and this means that the clamp circuit 22 functions. On the other hand, when the sensing signal VA generated by the bias sensing circuit 21 according to the input voltage VIN is lower than the clamp voltage VCP, because the sensing signal VA is lower than the clamp voltage VCP, the clamp circuit 22 does not control the level of the sensing signal VA and this means that the clamp circuit 22 does not function (to clamp the sensing signal VA). From one perspective, when the clamp circuit 22 does not function, the clamp circuit 22 has a high output resistance, and when the clamp circuit 22 functions, the clamp circuit 22 has a low output resistance.

In one embodiment, when the sensing signal VA exceeds the reference voltage VREF, the converter circuit 40 raises up the output voltage VO and/or the output current IO. When the sensing signal VA does not exceed the reference voltage VREF, the converter circuit 40 lowers down the output voltage VO and/or the output current IO. Thus, photovoltaic battery 10 is controlled to operate substantially near the MPP. According to the present invention, under a dynamic steady state, the sensing signal VA will be at a level which is substantially near the reference voltage VREF by the above-mentioned loop control.

In one embodiment, the clamp voltage VCP can be set to be greater than the reference voltage VREF. In one embodiment, the clamp voltage VCP is set to be slightly greater than the reference voltage VREF, such that when the input voltage VIN varies (e.g. because of changes in load condition, changes in illumination intensities or changes in temperatures), the present invention can respond to the variation within a short time, to control the operation loop of the power conversion apparatus such that the photovoltaic battery 10 can rapidly track the updated MPP in response to the changes.

Via the loop operation by the above-mentioned bias sensing circuit 21, the clamp circuit 22, the comparison circuit 30 and the converter circuit 40, the power conversion apparatus of the present invention can automatically track the MPP of the photovoltaic battery 10 and operate near the MPP. In addition, in one embodiment according to the present invention, the reference voltage VREF is not required to be directly correlated to operation parameters such as the voltage, current or MPP of the photovoltaic battery 10. That is, in one embodiment, the reference voltage VREF can be any value between the clamp voltage VCP and zero.

Please refer to FIG. 3B in in conjugation with FIG. 5. As shown in FIG. 3B, under a circumstance where the illumination intensity is very low (e.g., equal to or lower than the value 100 $W/m^2$ shown in FIG. 3B), at different illumination intensities or temperatures, the MPP voltage of the photovoltaic battery 10 varies greatly in accordance with the changes in the illumination intensities or temperatures. However, according to the present invention, the setting of the reference voltage VREF has a great flexibility (i.e., the reference voltage VREF is not required to be directly correlated to operation parameters such as the voltage, current or MPP of the photovoltaic battery 10), and from one perspective, this means that even under a very low illumination intensity, it is not required to adjust the reference voltage VREF in correspondence to different illumination intensities, and via the above-mentioned operation, the power conversion apparatus of the present invention can automatically track the MPP of the photovoltaic battery 10 and operate near the MPP.

For a power conversion apparatus, its MPP voltage in normal operation has a trackable range, that is, there is a minimum trackable voltage (VMIN) and there is a maximum trackable voltage (VMAX) for the MPP voltage. According to the present invention, in one embodiment, for the same reference voltage VREF, the minimum trackable voltage VMIN of the power conversion apparatus can be set to be equal to or lower than ½ of the maximum trackable voltage VMAX. In one embodiment, for the same reference voltage VREF, the minimum trackable voltage VMIN of the power conversion apparatus can be set to be equal to or lower than ⅕ of the maximum trackable voltage VMAX. In one embodiment, for the same reference voltage VREF, the minimum trackable voltage VMIN of the power conversion apparatus can be set to be equal to or lower than 1/10 of the maximum trackable voltage VMAX. Under a circumstance where the illumination intensity is very low, as mentioned above, the MPP voltage of the photovoltaic battery 10 will be greatly decreased as the illumination intensity decreases. However, the power conversion apparatus of the present invention, by the same reference voltage VREF, has a very broad range of tractable MPP voltage. As a result, the present invention is advantageous in an environment having low illumination intensity, such as for retrieving indoor illumination energy and converting such indoor illumination energy to electricity.

Figure 6:
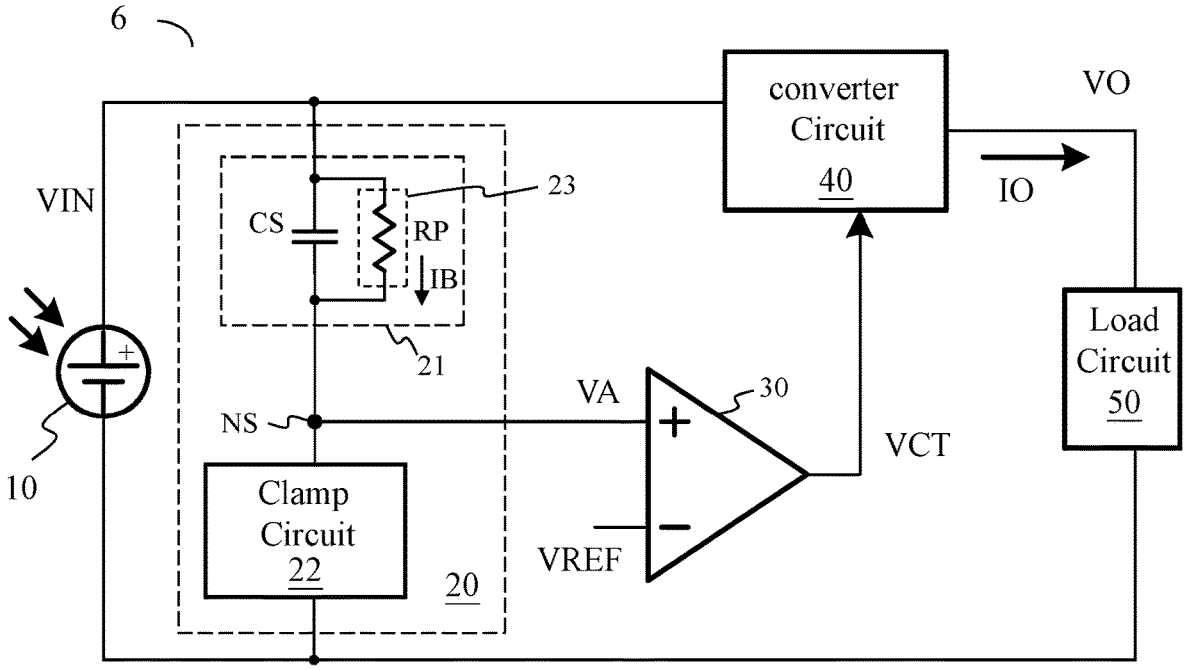
FIG. 6 shows another embodiment of a bias sensing circuit of the present invention.

Please refer to FIG. 6, which shows an embodiment of a bias sensing circuit 21 of the present invention. In one embodiment, the bias device 23 can be a bias resistor RP. Preferably, the resistance of the bias resistor RP and the capacitance of the sensing capacitor CS are so arranged that the sensing capacitor CS can hold the voltage difference (i.e., VIN−VCP) for at least a predetermined holding period. In one embodiment, the predetermined holding period is related to an operation bandwidth of the power conversion apparatus. In one embodiment, the bias resistor RP can be a parasitic resistor of the sensing capacitor; in this case, because an actual resistor device is not required, the cost can be further lowered.

In addition, according to the present invention, the operation point of the photovoltaic battery 10 can be adjusted by selecting or adjusting the resistance of the bias resistor RP. For example, by selecting or adjusting the resistance of the bias resistor RP to be a relatively low resistance, the photovoltaic battery 10 can be adjusted to operate at a relatively low voltage (i.e., a relatively low MPP voltage); by selecting or adjusting the resistance of the bias resistor RP to be a relatively high resistance, the photovoltaic battery 10 can be adjusted to operate at a relatively high voltage (i.e., a relatively high MPP voltage).

In other embodiments, the bias device 23 can be another type of circuit. For example, the bias device 23 can be a current source.

Figure 7:
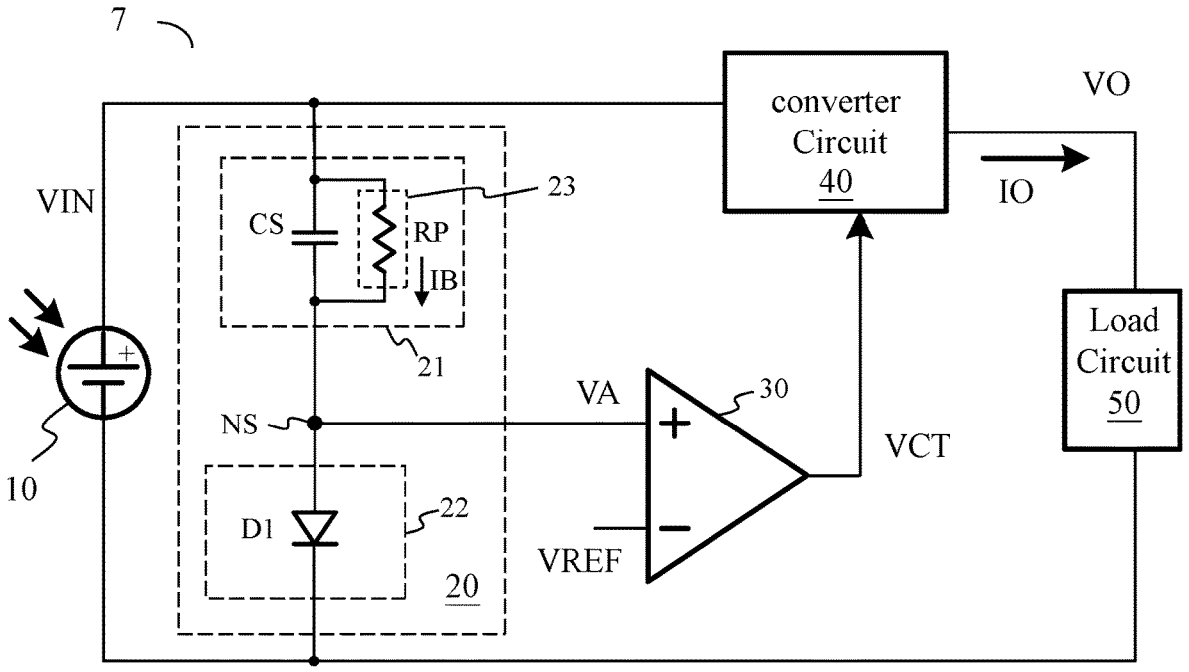
FIG. 7 shows an embodiment of a clamp circuit of the present invention.

Please refer to FIG. 7, which shows an embodiment of a clamp circuit 22 of the present invention. In this embodiment, the clamp circuit 22 for example includes a diode D1. The clamp voltage VCP is related to the forward bias voltage of the diode D1. In another embodiment, the clamp circuit 22 for example can include plural diodes, such as a diode group consisting of diodes connected in series. Under such situation, the clamp voltage VCP is related to a sum of the forward bias voltages of the diode group.

Figure 8:
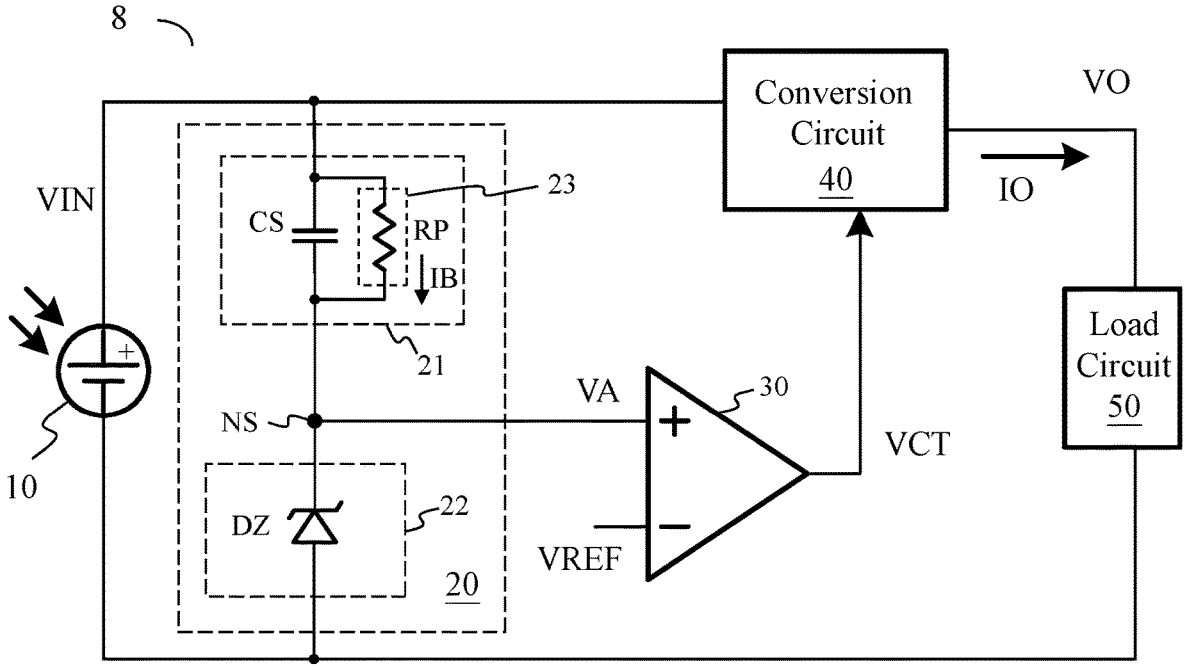
FIG. 8 shows an embodiment of another clamp circuit of the present invention.

Please refer to FIG. 8, which shows another embodiment of the clamp circuit 22 of the present invention. In this embodiment, the clamp circuit 22 for example can include a Zener diode DZ, wherein the clamp voltage VCP is related to the Zener voltage of the Zener diode DZ.

Figure 9A:
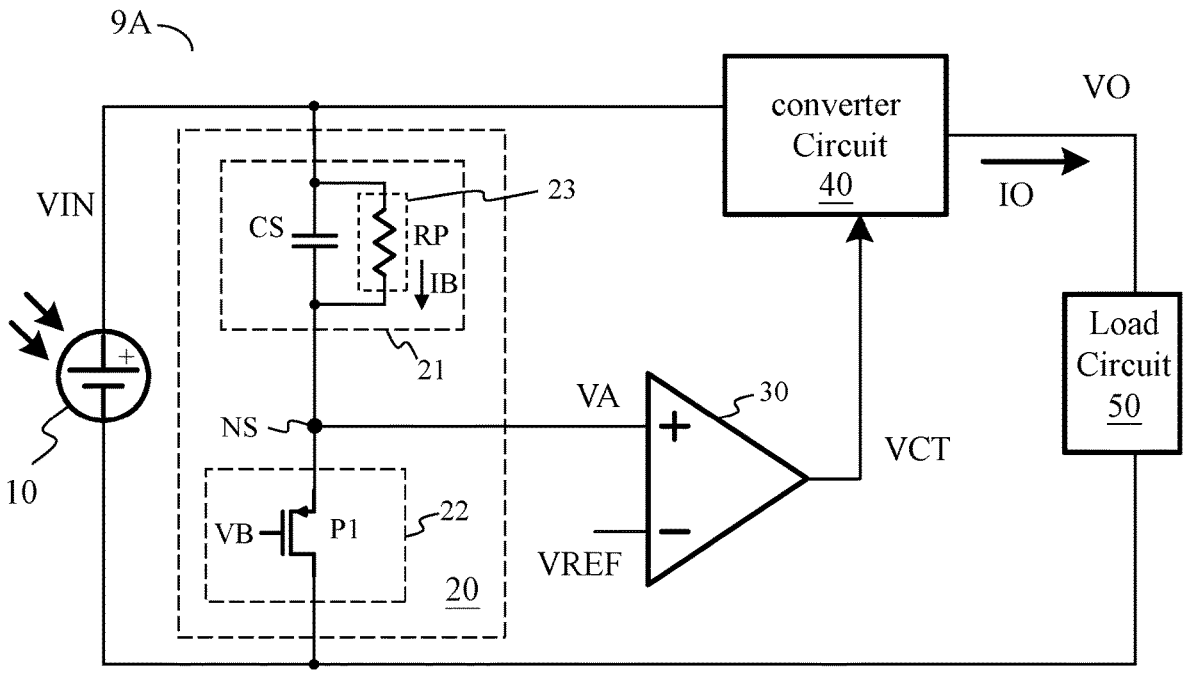
FIGS. 9A-9B show two other embodiments of the clamp circuit of the present invention.
Figure 9B:
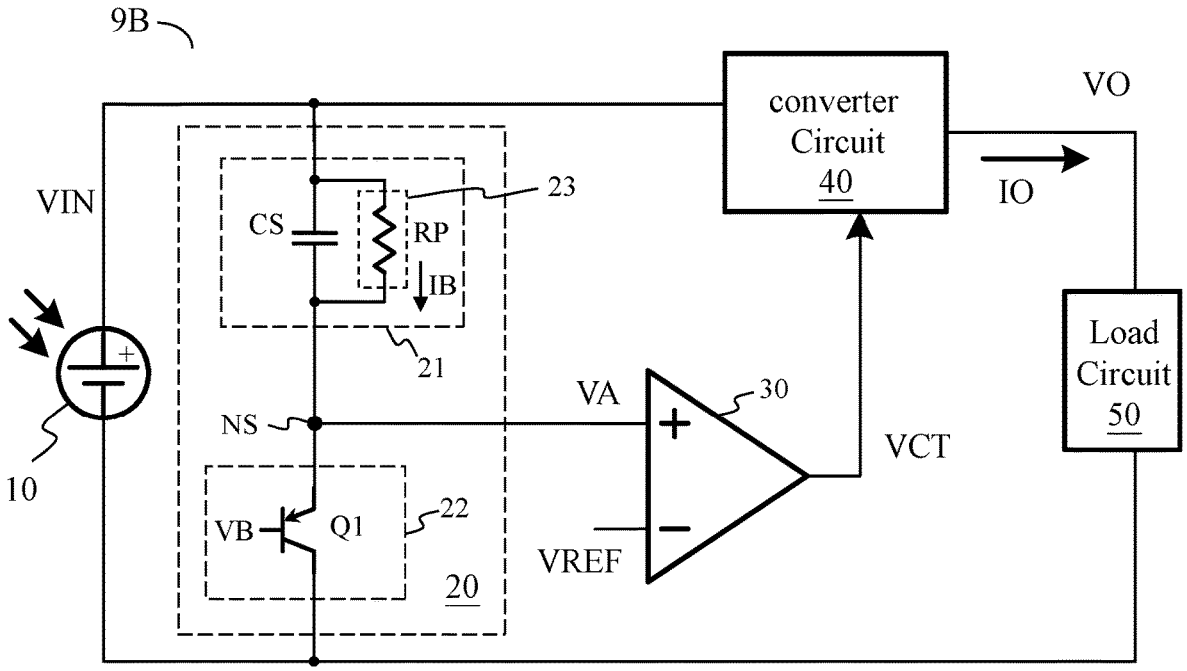

Please refer to FIGS. 9A-9B, which show two other embodiments of the clamp circuit 22 of the present invention. As shown in FIGS. 9A-9B, the clamp circuit 22 for example can include a transistor (as shown by P1 in FIG. 9A or as shown by Q1 in FIG. 9B) having a control terminal coupled to a bias voltage VB and having same-phase voltage input end coupled to the sensing node NS. The clamp voltage VCP is related to the bias voltage VB and the ON-threshold voltage of the transistor.

In one embodiment, the transistor P1 can be, for example but not limited to, a PMOS transistor (as shown in FIG. 9A). In another embodiment, the transistor Q1 can be, for example but not limited to, a PNP BJT transistor (as shown in FIG. 9B). In the present invention, the term "same-phase voltage input end" refers to an input end of a transistor which has a same-phase change as the control terminal of the transistor, which is a source of the PMOS transistor P1 in FIG. 9A, or an emitter of the PNP BJT transistor Q1 in FIG. 9B.

Figure 10:
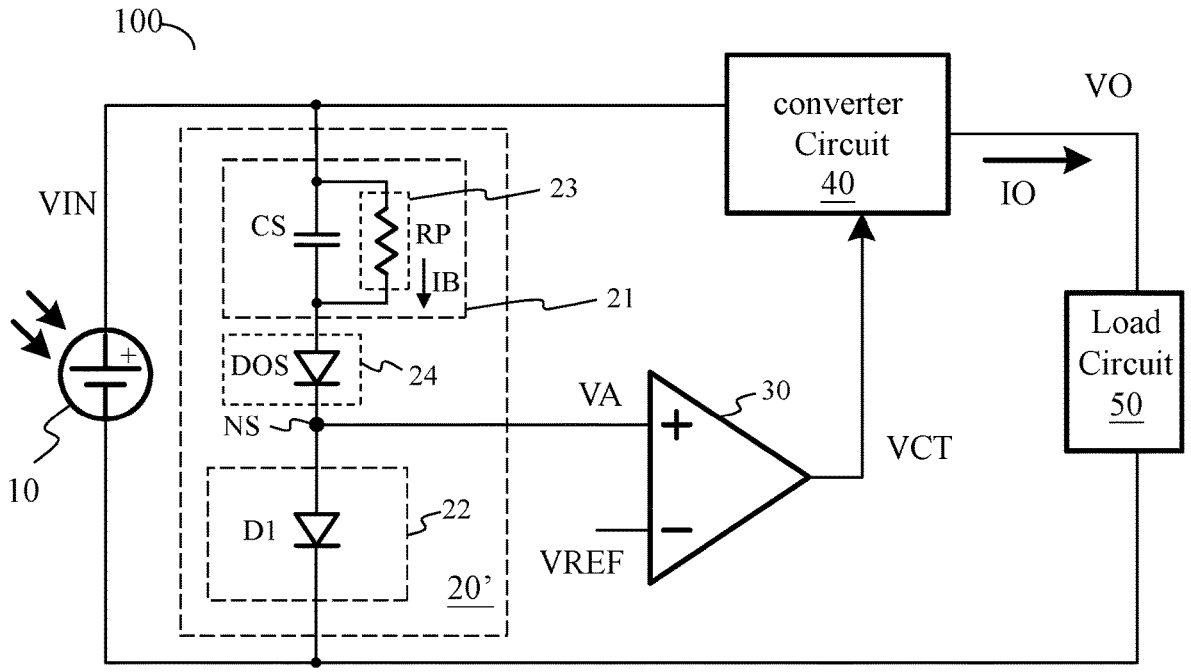
FIG. 10 shows an embodiment of a signal processing circuit of the present invention.

Please refer to FIG. 10, which shows another embodiment of a signal processing circuit of the present invention (signal processing circuit 20'). In this embodiment, the signal processing circuit 20' further includes an offset device 24. The offset device 24 and the bias sensing circuit 21 are connected in series between the input power and the sensing node NS. The offset device 24 is configured to operably provide an offset voltage, so as to generate the sensing signal VA. The location of offset device 24 with respect to the bias sensing circuit 21 is not limited to the figure shown. For example, the location of the offset device 24 and the location of the bias sensing circuit 21 can be interchanged, that is, the offset device 24 can be directly coupled to the input voltage VIN. In one embodiment, as shown in FIG. 10, the offset device 24 includes an offset diode DOS. In this embodiment, the offset voltage is related to the forward bias voltage of the offset diode DOS.

As mentioned above, the MPP of the photovoltaic battery 10 (or any other type of power retrieval source) varies in accordance with changes in temperatures. According to the present invention, in one embodiment, the photovoltaic battery 10 (or any other type of power retrieval source) and the clamp circuit 22 include semiconductor junctions of the same characteristics, such that the variation of the clamp voltage VCP and the variation of the input voltage VIN with respect to a temperature change are positively correlated to each other. For example, in one embodiment, both of the photovoltaic battery 10 and the clamp circuit 22 (e.g., diode D1) include a P-N semiconductor junction, so that the variations of the clamp voltage VCP and the input voltage VIN with respect to a temperature change are positively correlated to each other.

The present invention has been described in considerable detail with reference to certain preferred embodiments thereof. It should be understood that the description is for illustrative purpose, not for limiting the scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, the clamp device can be a combination of two or more of the above-mentioned diode, Zener diode and transistor. Under such circumstance, the clamp voltage will be a sum of parameters of the respective devices (forward bias voltage, Zener voltage and/or ON-threshold voltage). For another example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described herein before to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A power conversion apparatus for tracking maximum power point, which receives an input power supplied by a power retrieval source; the power conversion apparatus comprising:

a signal processing circuit, which is configured to operably generate a sensing signal at a sensing node according to an input voltage of the input power;

a comparison circuit, which is configured to operably generate a control signal according to a difference between the sensing signal and a reference voltage; and a converter circuit, which is configured to operably convert the input power to an output power according to the control signal, so as to supply the output power to a load circuit;

wherein the signal processing circuit includes:

a bias sensing circuit coupled between the input power and the sensing node, wherein the bias sensing circuit is configured to operably generate the sensing signal at the sensing node according to the input voltage; and a clamp circuit coupled to the sensing node, wherein the clamp circuit is configured to operably clamp the sensing signal so that the sensing signal is not greater than a clamp voltage;

wherein the bias sensing circuit includes a sensing capacitor which is connected between the input power and the sensing node;

wherein the converter circuit adjusts an output voltage and/or an output current of the output power according to the control signal, so that the power retrieval source operates near a maximum power point.

2. The power conversion apparatus of claim 1, wherein the bias sensing circuit further includes:

a bias device, which is configured to operably supply a bias current and is connected in parallel with the sensing capacitor between the input power and the sensing node.

3. The power conversion apparatus of claim 1, wherein the clamp circuit includes one of the followings or a combination thereof:

(1) a diode, wherein the clamp voltage is related to a forward bias voltage of the diode;

(2) a Zener diode, wherein the clamp voltage is related to a Zener voltage of the Zener diode; and/or (3) a transistor having a control terminal coupled to a bias voltage and having a same-phase voltage input end coupled to the sensing node, wherein the clamp voltage is related to the bias voltage and an ON-threshold voltage of the transistor.

4. The power conversion apparatus of claim 1, wherein the signal processing circuit further includes:

an offset device, wherein the offset device and the bias sensing circuit are connected in series between the input power and the sensing node, the offset device being configured to operably supply an offset voltage, so as to generate the sensing signal.

5. The power conversion apparatus of claim 4, wherein the offset device includes an offset diode, and the offset voltage is related to a forward bias voltage of the offset diode.

6. The power conversion apparatus of claim 1, wherein:

when the sensing signal exceeds the reference voltage, the converter circuit raises up the output voltage and/or the output current; and when the sensing signal does not exceed the reference voltage, the converter circuit lowers down the output voltage and/or the output current;

such that the power retrieval source operates near the maximum power point.

7. The power conversion apparatus of claim 1, wherein:

when the input voltage increases whereby the clamp circuit starts to function and the clamp circuit clamps the sensing signal at the clamp voltage, the sensing capacitor samples a voltage difference between the input voltage and the clamp voltage; and when the input voltage decreases whereby the clamp circuit does not function, the sensing capacitor holds the voltage difference such that the sensing signal is lower than the clamp voltage and the sensing signal is positively correlated with the input voltage.

8. The power conversion apparatus of claim 7, wherein the bias device is a bias resistor, and wherein a resistance of the bias resistor and a capacitance of the sensing capacitor are so arranged that the sensing capacitor holds the voltage difference for at least a predetermined holding period.

9. The power conversion apparatus of claim 8, wherein the predetermined holding period is related to an operation bandwidth of the power conversion apparatus.

10. The power conversion apparatus of claim 8, wherein the bias resistor is a parasitic resistor of the sensing capacitor.

11. The power conversion apparatus of claim 1, wherein the clamp voltage is greater than the reference voltage.

12. The power conversion apparatus of claim 11, wherein the reference voltage is any value between the clamp voltage and zero.

13. The power conversion apparatus of claim 11, wherein the reference voltage is not correlated to an operation parameter of the maximum power point of the power retrieval source.

14. The power conversion apparatus of claim 11, wherein voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than ½ of the maximum trackable voltage.

15. The power conversion apparatus of claim 11, wherein voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than ⅕ of the maximum trackable voltage.

16. The power conversion apparatus of claim 11, wherein voltages of the maximum power point of the power retrieval source have a trackable range by the power conversion apparatus, and the range includes a minimum trackable voltage and a maximum trackable voltage, wherein at a predetermined level of the reference voltage, the minimum trackable voltage is lower than 1/10 of the maximum trackable voltage.

17. The power conversion apparatus of claim 1, wherein the power retrieval source includes a photovoltaic battery, which is configured to operably retrieve a solar power to supply the input power.

18. The power conversion apparatus of claim 1, wherein the power retrieval source and the clamp circuit include semiconductor junctions of same characteristics, such that a variation of the clamp voltage and a variation of the input voltage with respect to a temperature change are positively correlated to each other.

19. A control method for a power conversion apparatus, wherein the power conversion apparatus receives an input power supplied by a power retrieval source, and the power conversion apparatus includes a converter circuit; the control method comprising:

generating a sensing signal at a sensing node according to an input voltage of the input power;

controlling the converter circuit according to a difference between the sensing signal and a reference voltage, to convert the input power to an output power and to supply the output power to a load circuit; and clamping the sensing signal such that the sensing signal is not greater than a clamp voltage;

wherein the step for generating the sensing signal includes:

sensing the input voltage by a sensing capacitor which is connected between the input power and the sensing node, so as to generate the sensing signal at the sensing node;

wherein the converter circuit is controlled to adjust an output voltage and/or an output current of the output power, so that the power retrieval source operates near a maximum power point.

20. The control method of claim 19, wherein the step for generating the sensing signal further includes:

sensing the input voltage by a bias device connected in parallel with the sensing capacitor, so as to generate the sensing signal at the sensing node;

wherein the sensing capacitor and the bias device connected in parallel with each other are coupled between the input power and the sensing node.

21. The control method of claim 19, wherein the sensing signal is clamped by one of the followings or a combination thereof:

(1) a diode, wherein the clamp voltage is related to a forward bias voltage of the diode;

(2) a Zener diode, wherein the clamp voltage is related to a Zener voltage of the Zener diode; and/or (3) a transistor having a control terminal coupled to a bias voltage and having a same-phase voltage input end coupled to the sensing node, wherein the clamp voltage is related to the bias voltage and an ON-threshold voltage of the transistor.

* * * * *